US005643031A

United States Patent [19]

Fenton et al.

[11] Patent Number: 5,643,031

[45] Date of Patent: Jul. 1, 1997

[54] AQUATIC VEHICLE

[75] Inventors: Vernon K. Fenton, Riverton, Wyo.; Sheldon D. Larson, Rexburg, Id.

[73] Assignee: X-Stream Unlimited, Inc., Riverton, Wyo.

[21] Appl. No.: 639,725

[22] Filed: Apr. 29, 1996

[51] Int. Cl.[6] ..... B63C 9/08

[52] U.S. Cl. ..... 441/130; 114/345

[58] Field of Search ..... 441/65–67, 129–131; 114/345, 266, 267, 363

[56] References Cited

U.S. PATENT DOCUMENTS

| | | | |
|---|---|---|---|
| 1,552,751 | 9/1925 | Marriott . | |
| 2,154,040 | 4/1939 | Frisendahl | 114/345 |
| 2,894,270 | 7/1959 | Manthos . | |
| 2,958,876 | 11/1960 | Garrett . | |
| 4,771,722 | 9/1988 | Tihany . | |
| 4,938,722 | 7/1990 | Rizley . | |
| 4,973,278 | 11/1990 | Williams . | |
| 5,046,978 | 9/1991 | Howerton . | |
| 5,090,930 | 2/1992 | Walden . | |
| 5,295,885 | 3/1994 | Karl . | |

FOREIGN PATENT DOCUMENTS

| | | | |
|---|---|---|---|
| 0019769 | of 1899 | United Kingdom | 114/345 |

*Primary Examiner*—Edwin L. Swinehart

*Attorney, Agent, or Firm*—Edwin S. Wall; Wall & Constantino, L.C.

[57] ABSTRACT

A floatable aquatic vehicle for receiving and suspending an individual in a seated, floating configuration in water. The vehicle includes a support frame having an egg-like configuration. The egg-like configuration of the frame is a continuously arcuate enclosure having a large radius of curvature at a first side and a smaller radius of curvature at an opposing second side, the first and second sides being joined together. The vehicle also includes a flexible cover for encasing a buoyant float and a central opening for receiving the individual. The frame is coupled to the flexible cover so that the frame supports the cover at the opening.

16 Claims, 4 Drawing Sheets

AQUATIC VEHICLE

BACKGROUND OF THE INVENTION

1. The Field of the Invention.

The present invention pertains generally to the field of aquatic vehicles, and more particularly to a floatable aquatic vehicle for receiving and suspending an individual in a seated, floating, configuration in water.

2. The Background Art.

Aquatic floatation vehicles have been developed for a variety of uses in the area of sports, including floatation devices designed for the individual user. There has developed a specific need for a floating vehicle for the individual who is fishing, hunting or diving. Vehicles which meet this specific need primarily employ inner-tubes for floatation.

Advances in inner-tube vehicle technology have primarily involved improvement in the propulsion system of these crafts. Thus, one can find various propulsion/support devices which attach either to the inner-tube or to the individual user. There have also been developments in a variety of seats, straps, and other such related devices.

One of the problems associated with using inner-tubes in an aquatic vehicle is instability in support of the individual user, particularly in moving water. This problem is partially due to the distribution of weight of the vehicle on the water. This is particularly problematic when the individual is shifting their weight while in the device.

Generally, inner-tube vehicles do not have sufficient balance and stability to be used in rough water conditions, such as where the water develops waves or becomes choppy. Additionally, individual inner-tube vehicles are not sufficiently stable for use on streams or rivers where there may be rough water currents, known as "white water". Not only is the use of individual inner-tube vehicles limited because of their instability, but they are also limited structurally because they generally cannot withstand impacts with rocks and water born objects, and tend to bend or buckle.

OBJECTS AND SUMMARY OF THE INVENTION

It is therefore an object of the present invention to buoyantly support an individual when in the water.

It is another object of the invention, in accordance with one aspect thereof, to provide an aquatic vehicle which is stable, has good balance, and does not readily tip over in the water.

It is another object of the invention, in accordance with one aspect thereof, to provide an aquatic vehicle which is strong and does not easily bend or buckle upon impact.

It is another object of the invention, in accordance with one aspect thereof, to provide an aquatic vehicle which may be used when fishing, hunting, diving and recreational floating.

It is another object of the invention, in accordance with one aspect thereof, to provide an aquatic vehicle which is adjustable according the weight of the individual using it and the activity involved.

It is another object of the invention, in accordance with one aspect thereof, to provide an aquatic vehicle in which an individual may engage in white water rafting.

It is another object of the invention, in accordance with one aspect thereof, to provide an aquatic vehicle which will not sink if an individual float is punctured or deflates.

It is another object of the invention, in accordance with one aspect thereof, to provide protection to the frame of the aquatic vehicle when the vehicle is in use.

It is another object of the invention, in accordance with one aspect thereof, to provide shelter from the wind, rain, snow, or other weather.

It is another object of the invention, in accordance with one aspect thereof, to camouflage the aquatic vehicle.

It is another object of the invention, in accordance with one aspect thereof, to provide an aquatic vehicle having a working space.

It is an additional object of the invention, in accordance with one aspect thereof, to provide an aquatic vehicle which may be propelled through the water.

The above objects and others not specifically recited are realized in a specific illustrative embodiment of a floatable aquatic vehicle for receiving and suspending an individual in a seated, floating configuration in water. The vehicle includes a support frame having a perimeter of egg-like configuration. The egg-like configuration of the frame is a continuously arcuate enclosure having a large radius of curvature at a first side and a smaller radius of curvature at an opposing second side, the first and second sides being joined together. The vehicle also includes a flexible cover for encasing a buoyant float and a central opening for receiving an individual user. In the preferred embodiment, the cover forms a toric tube when encasing a float and conforms to the perimeter of the frame. A seat is attached to the frame for the individual to sit on. The frame is coupled to the flexible cover so that the frame supports the cover at the opening. The coupling may be adjustable so that the position of the frame with respect to the cover may be selectively varied.

Reinforcing members or bars are attached diagonally to the perimeter of the frame in the preferred embodiment. The reinforcing members provide additional support to the frame. A strap for supporting the individual in a seated position is attached at one end to the frame and at the other end to the cover so that the strap extends across the opening and passes between the legs of the individual.

Other objects, features, advantages and alternative aspects of the present invention will become apparent to those skilled in the art from a consideration of the following detailed description taken in combination with the accompanying drawings.

BRIEF DESCRIPTION OF THE DRAWINGS

The above objects and features of the invention will become apparent from consideration of the detailed description in connection with the drawings, in which.

DETAILED DESCRIPTION

Figure 1:
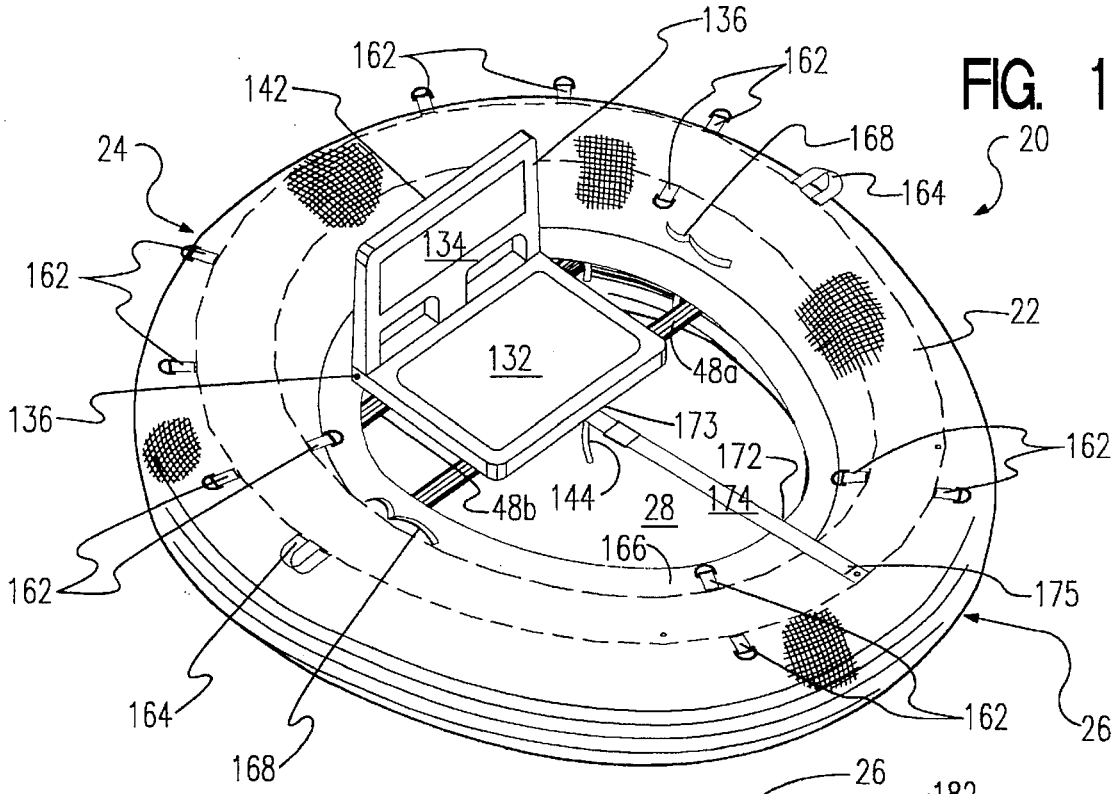
FIG. 1 is a top perspective view of an aquatic vehicle made in accordance with the principles of the present invention.

References will now be made to the drawings wherein like structures will be provided with like reference numerals.

Referring to FIG. 1, there is shown an Aquatic Vehicle, generally designated at 20. The Aquatic vehicle 20 includes a flexible cover 22 which encases one or more buoyant floats (not shown). As in FIG. 1, once the floats are encased within the cover 22 the vehicle 20 has a generally toric shape, with the fabric forming an arcuate tube-like configuration having a large radius of curvature rear section, generally indicated at 24, a smaller radius of curvature at the front section, generally indicated at 26, and defining a central opening 28.

The flexible cover 22 may be any fabric or plastic material, and in the preferred embodiment it is a woven, high strength, flexible nylon fabric. The fabric provides structure and support to the cover 22 for enclosing the floats and helps prevent the floats from becoming cut, torn or punctured.

Figure 2:
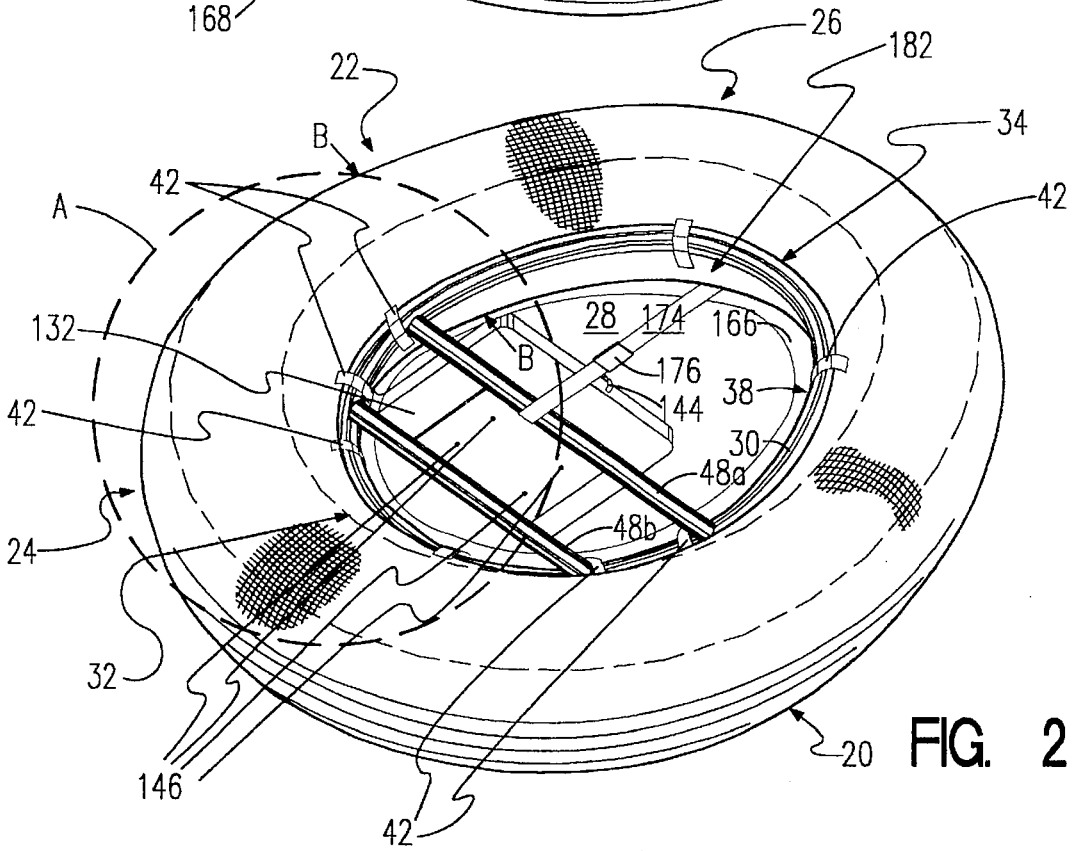
FIG. 2 is a bottom perspective view of the embodiment of the invention of FIG. 1.

FIG. 2 shows the support frame 30 of the vehicle 20. The frame 30 comprises a continuously arcuate enclosure having a large radius of curvature at a first side, generally indicated at 32, and a smaller radius of curvature at an opposing second side, generally indicated at 34. The first and second sides 32 and 34 are joined together to form a perimeter 38 having an egg-like configuration.

In the preferred embodiment, the support frame 30 is coupled to the flexible cover 22 by straps 42. The straps 42 couple the support frame 30 to the flexible cover 22 so that the frame 30 supports the cover 22 at the opening 28. Thus, the cover 22 conforms to the shape of the perimeter 38 of the frame 30, which will be discussed momentarily. Those skilled in the art will appreciate that in addition to straps 42, numerous other devices could be used to couple the frame 30 to the cover 22, including: buckles, cords, belts, snaps, hooks, hitches, latches, Velcro™, lashings, and the like.

As shown in FIG. 2, the perimeter 38 of the frame 30 is positioned in the opening 28 and the cover 22. It should be particularly noted that the front section 26 of the cover 22 is supported by the second side 34 of the frame and the rear section 24 of the cover 22 is supported by the first side 32 of the frame. Thus, the cover 22 and the buoyant float encased within it generally conform to the egg-like configuration of the frame 30. The egg-like configuration of the frame 30, the preferred embodiment shown in FIG. 2 being egg-shaped, provides structural integrity, resistance to bending and buckling, and balance of the frame 30 (and the vehicle 20) through its geometric shape and load distribution. The large radius of curvature at a first side 32 of the frame 30 and the smaller radius of curvature at an opposing second side 34 provide enhanced stability to the vehicle 20, by advantageously distributing weight of the vehicle 20 in the water.

At least one reinforcing member 48*a/b* may be attached diagonally to the perimeter 38 of the frame 30 to provide additional support. In the preferred embodiment shown in FIG. 2, the reinforcing members 48*a/b* are shown as bars or tubes attached diagonally to the perimeter 38. It will be appreciated by those skilled in the art that the reinforcing member 48*a/b* enhances the structural integrity and resistance to bending and buckling of the frame 30.

Figure 3:
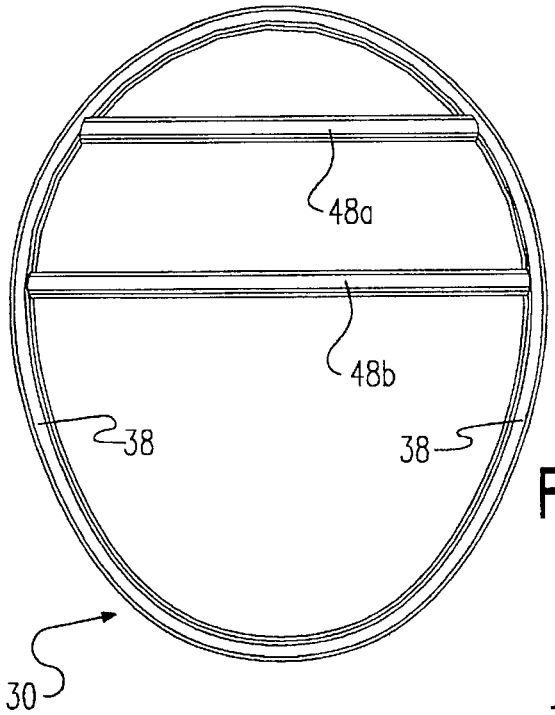
FIG. 3 is a top view of a component of FIG. 2.

FIG. 3 provides a top view of the frame 30, showing the perimeter 38 and the reinforcing members 48*a/b* . It will be noted the perimeter 38 of the frame 30 has an egg-like configuration, the preferred embodiment being egg-shaped, as previously discussed.

Figure 4:
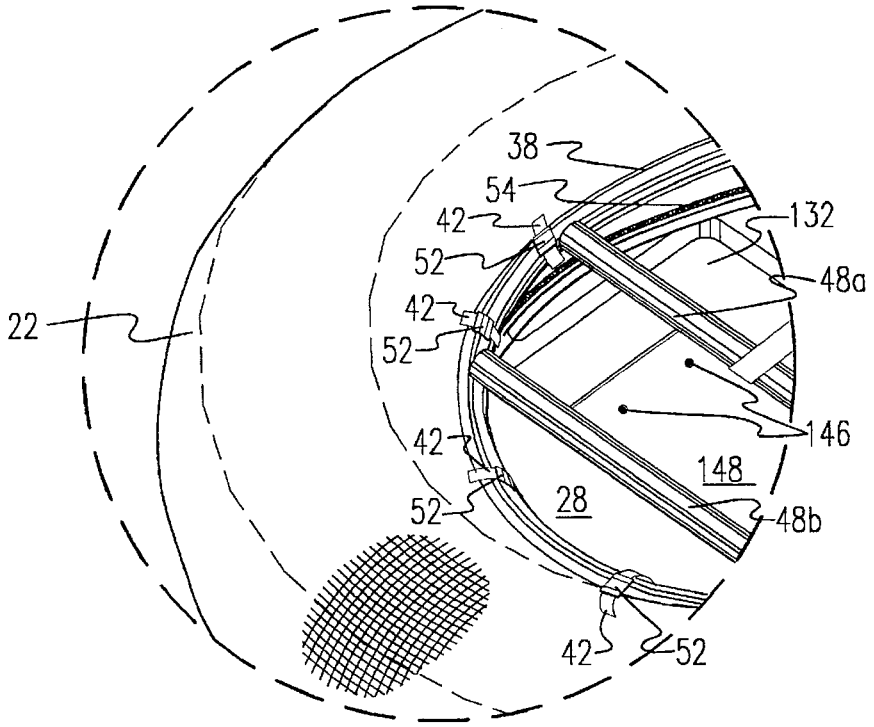
FIG. 4 is a bottom perspective view of FIG. 2, Region A.

Referring not to FIG. 4, which is an enlarged view of FIG. 2, Region A, one can see the adjustment straps 42 extend from the cover 22 and around the perimeter 38 of the frame 30. The length adjustment strap 42 may be changed using the buckle 52 in order to selectively vary the position of the frame 30 with respect to the cover 22.

Also shown in FIG. 4 is a zipper 54, which runs around the opening 28. The zipper 54 provides access to the inside the cover 22 and provides a means for securing the cover 22 around the floats when they are encased by the cover 22.

Referring again to FIG. 1, there is shown a seat 132 having a pivotal back support 134 which folds along hinges 136 and is mounted on a reinforcing members 48*a/b* of the frame. When folded, the top 142 of the back support 134 may be secured to the seat 132 by a strap 144.

Also shown in FIG. 1, are plurality of eyelets or rings 162. The rings 162 provide a means for securing objects to the vehicle 20. Two oar rings 164 are located opposite one another on the cover 22. Oars (not shown) may be inserted trough the oar rings 164 for use by an individual sitting on the seat 132 and used as a method for propelling the vehicle 20 through the water (not shown). It will be appreciated by those skilled in the art that any method of propelling the vehicle 20 through the water may be employed, including attaching an outboard boat motor.

A skirt 166 is attached to and extends from the cover 22, covering and protecting the perimeter of the frame. Additionally, holding means 168 for holding fishing rods for fishermen, hunting equipment for hunters, diving flags and equipment for divers, are located on and attached to the cover 22 of the vehicle 20. An inflation nozzle 172 for inflating the float is located at and extends trough the cover 22.

A safety strap 174 passes between the legs of an individual to provide support when using the vehicle 20. A first end 173 of the strap 174 is attached to a reinforcing member 48 beneath the seat 132. The strap extends across the opening 28 to the front section 26 of the cover 22, where the second end 175 is attached.

Referring again to FIG. 2, it will be noted that the first end 173 of the strap 174 is attached to the reinforcing member 48, and that the strap 174 has a buckle 176, which allows the safety strap 174 to be buckled and unbuckled. Also note that the skirt 166 covers the straps 42 and helps to protect them from damage and prevent them from uncoupling.

Other features shown include a second inflation nozzle 182 for inflating the float encased with the cover 22 and the seat 132, which is secured to the frame 30 by screws 146 through the plate 148.

Figure 5:
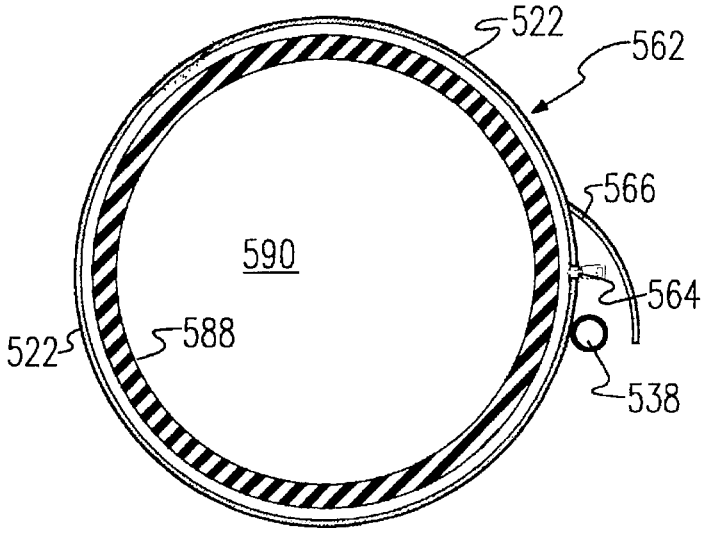
FIG. 5 is a cross sectional view of FIG. 2 along section line B—B.
Figure 6:
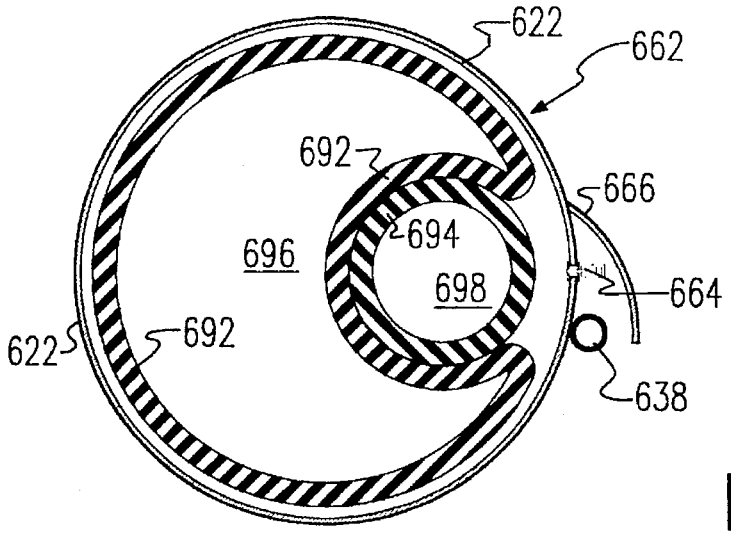
FIG. 6 is an alternative embodiment of FIG. 5.
Figure 7:
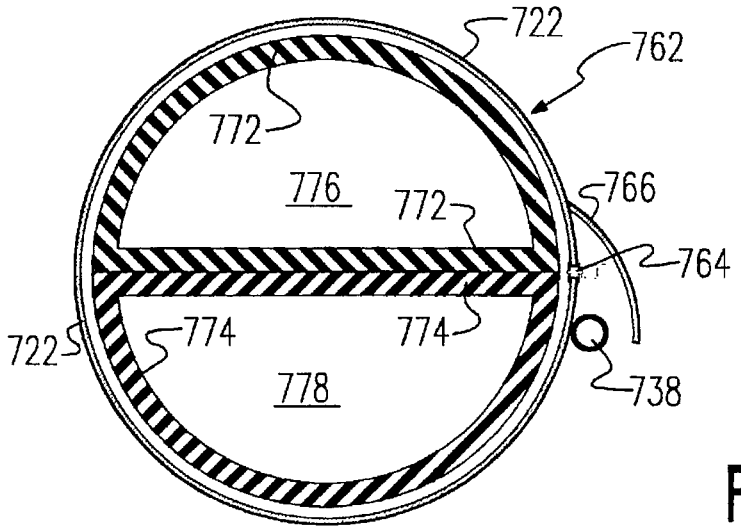
FIG. 7 is an alternative embodiment of FIG. 5.

Moving now to FIGS. 5–7, there are shown cross sections of alternative embodiments of floats which may be encased within the cover 22.

FIG. 5 is a cross section of the preferred embodiment of an encased float, generally indicated at 562, where the cover 522 forms a tear and puncture resistant outer layer which is closed by the zipper 564. A skirt 566 of material is attached to the cover 522 and extends over the zipper 564 and the perimeter 538 of the frame. The skirt 566 provides protection to the perimeter 538 of the frame, as well as the straps (not shown) which connect the frame to the cover 522. The cover 522 encases a toric tube or inner-tube forming a waterproof inflatable inner layer 588. As shown, the inner layer 588 forms a chamber 590 which is shown filled with air, but which may be filled with a buoyant foam, gases, or other buoyant material.

FIG. 6 shows a cross section of an alternative embodiment of an encased float, generally indicated at 662, where the cover 622 by the zipper 664. A skirt 666 of material is attached to the cover 622 and extends over the zipper 664 and the perimeter 638 of the frame. Here, the float comprises two toric shaped tubes, shown as first and second waterproof inflatable inner layers 692 and 694 forming first and second chambers 696 and 698, respectively. As can be seen, inner layers 692 and 694 are disposed in circumferential contact with one another.

FIG. 7 shows another cross section of an alternative embodiment of an encased float, generally indicated at 762, where the cover 722 by the zipper 764. A skirt 766 of material is attached to the cover 722 and extends over the zipper 764 and the perimeter 738 of the frame. Here, the cover 722 encases primary and secondary inner waterproof inflatable inner layers 772 and 774, forming primary and secondary chambers 776 and 778. This alternative embodiment further shows an additional configuration for disposing the inner layers 772 and 774 in circumferential contact with one another.

The embodiments shown in FIGS. 6 and 7, provide an aquatic vehicle which, in addition to other uses, is particularly well suited for white water rafting, as the aquatic vehicle will not sink if one of the floats is punctured or deflates.

Figure 8:
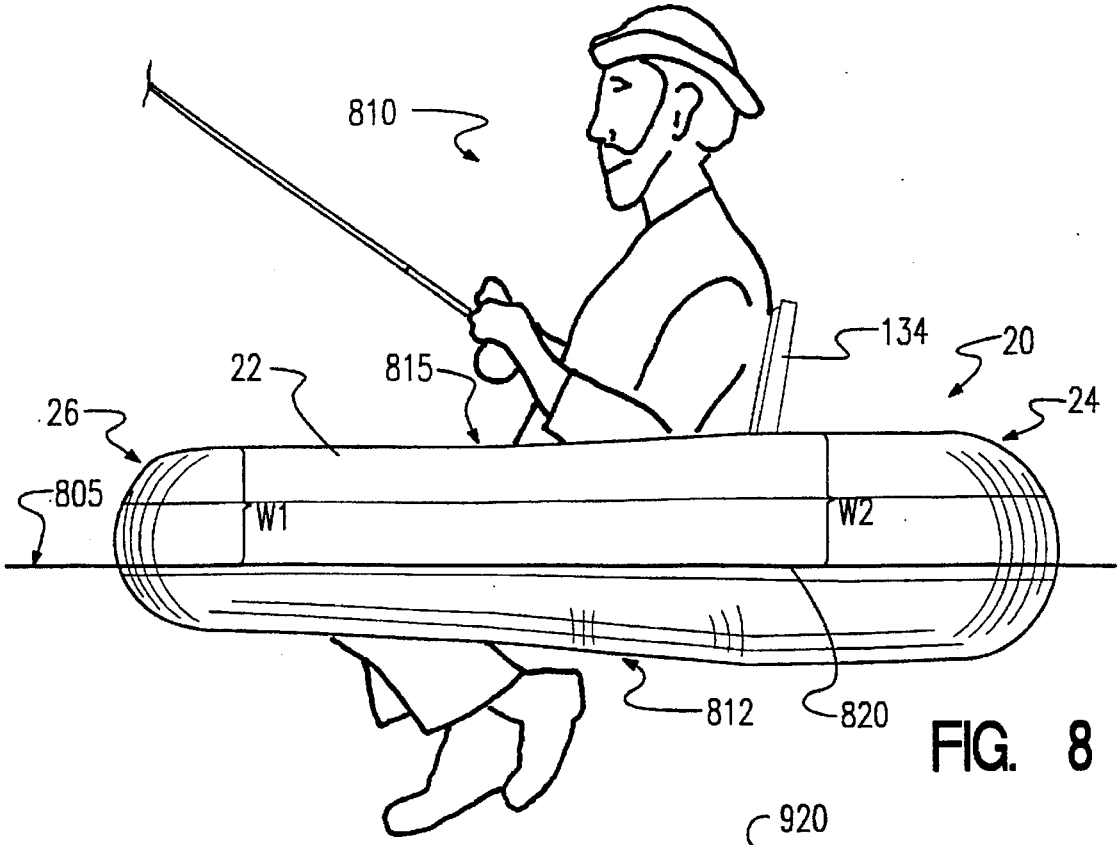
FIG. 8 is a side view of FIG. 1.

FIG. 8 shows the side view of FIG. 1, as the vehicle 20 would appear while being used in water 805 by an individual 810. While the individual 810 is shown fishing, it is to be understood the vehicle 20 could also be used while hunting, diving, as transportation, recreational floating, and other activities requiring suspending an individual in a seated, floating, configuration in water. The individual 810 is received in the opening (not shown), and may sit on the seat (not shown), against the back support 134, with legs passing through the opening. When the individual 810 is in the vehicle 20, the weight of the vehicle 20 is distributed toward the rear section 24.

As shown, the cross sectional area of the cover 22 increases as the cover 22 progresses from the front section 26 to the rear section 24. In FIG. 8, the increase in the cross sectional area of the cover 22 is shown midway between the front section 26 and he rear section 24, where there is a downward angle to the cover 22 at 812.

The purpose for the increase in the cross sectional area of the cover 22 is to enclose more float toward the rear section 24 help level the top 815 of vehicle 20 with respect to the surface of the water 805 when it is being used by an individual 810. When the top 815 of the vehicle is approximately level with the surface of the water 805, the vehicle is more stable, easier to control, and less likely to tip over. FIG. 8 shows both the front section 26 and the rear section 24 of the cover 22 are approximately level along top 815 with respect to the surface of the water 805 because of the increased buoyancy due to the in the cross sectional area of the cover 22. The distances w1 and w2, from the top 815 of the vehicle to the water line 820 at the surface of the water 805 are approximately equal. The downward angle 812 of the preferred embodiment is one way to increase the cross sectional area encased by the cover 22 so that the top 815 is approximately level. It will be appreciated by those skilled in the art that the increase could also be achieved in a number of other ways, such as gradual increases or an overall angulation of the cover 22.

Figure 9:
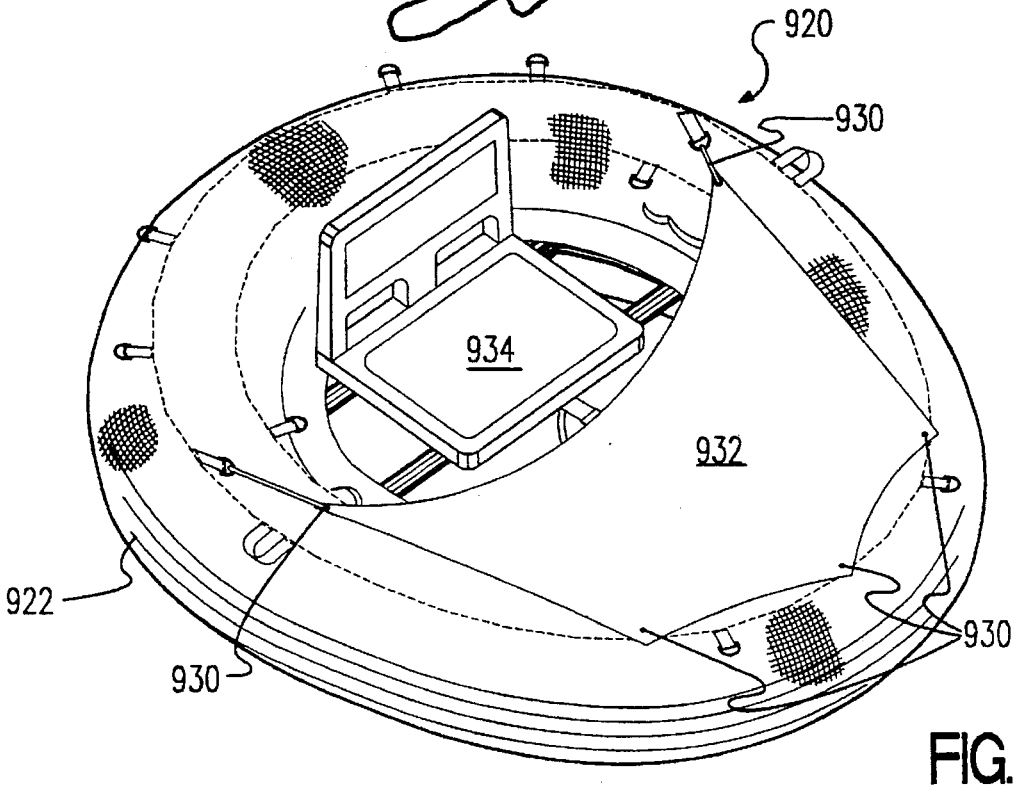
FIG. 9 is an alternative embodiment of FIG. 1.

FIG. 9 shows an alternative embodiment of an aquatic vehicle 920. In this embodiment coupling means 930 are attached to the cover 922 for coupling a canopy 932. The canopy 932 may partially or entirely blanket the cover 922, seat 934 or individual in the vehicle 920. The canopy 932 may provide shelter from the wind, rain, snow, or weather, camouflage for hunters, or a working space for arranging equipment or measuring and field dressing fish, birds or other quarry.

The present invention represents a significant advance over the prior apparatus, methods and art of aquatic vehicles. For example, many of the advantages of the present invention accrue with the use of an egg-like configuration of the frame 30. The larger radius of the frame 30 at the first side 32 increases the circumference of the cover 22 at the rear section 24. Thus, the float encased within the cover 22 is distributed over a larger area at the rear section 24 than at the front section 26, providing an aquatic vehicle which is more stable, has good balance, and does not readily tip over in the water. Additionally, the egg-like configuration of the perimeter 38 of the frame 30 does not easily bend or buckle, providing strength to the vehicle.

An added advantage of the preferred embodiment is that the frame can be adjusted with respect to the cover, further compensating for the weight of the individual using the vehicle and permitting the individual to sit higher, as might be desirable when hunting, while sitting lower, as might be desirable when fishing.

It is to be understood that the above-described arrangements are only illustrative of the application of the principles of the invention. Numerous modifications and alternative arrangements may be devised by those skilled in the art without departing from the spirit and scope of the present invention and the appended claims are intended to cover such modifications and arrangements.

What is claimed is:

1. A floatable aquatic vehicle for receiving and suspending an individual in a seated, floating, configuration in water comprising:

a support frame comprising a continuously arcuate enclosure having a first radius of curvature at a first side and a smaller radius of curvature at an opposing second side, the first and second sides being joined together to form a perimeter having an egg-shaped configuration;

flexible cover means for encasing buoyant float means and defining a central opening for receiving the individual; and means for coupling the support frame to the flexible cover means so that the frame supports the cover means at the opening.

2. The vehicle as in claim 1, wherein said support frame further comprises a reinforcing member attached diagonally to the perimeter of the frame for supporting the perimeter.

3. The vehicle as in claim 1, wherein said means for coupling the support frame to the flexible cover means further comprises adjustment means for selectively varying the position of the frame with respect to the cover means when the frame is coupled to the cover means.

4. The vehicle as in claim 1, wherein said cover means further comprises a toric tube having a front section and a rear section, the front section being supported by and laterally conforming to the second side of the frame and the rear section being supported by and laterally conforming to the first side of the frame, the cross sectional area of the toric tube increasing as the toric tube progresses from the front section to the rear section.

5. The vehicle as in claim 1, wherein said vehicle further comprises a seat attachable to the frame.

6. The vehicle as in claim 5, wherein said vehicle further comprises a back rest pivotally connected to the seat.

7. The vehicle as in claim 5, wherein said vehicle further comprises a strap for supporting the individual, the strap having a first end attached to the frame and a second end attached to the cover means such that the strap extends across the opening and is adapted to pass between the legs of the individual.

8. The vehicle as in claim 1, wherein said vehicle further comprises:

cover means configured in a toric tube shape; and float means comprising at least two toric shaped floats disposed in circumferential contact with one another, the floats being adapted for encasement within the cover means.

9. The vehicle as in claim 1, wherein said cover means further comprises protective skirting means for protecting the frame, the skirting means being attached to the cover means about the opening and covering at least a portion of the perimeter of the frame when the frame is coupled to the cover means.

10. The vehicle as in claim 1, wherein said vehicle further comprises coupling means attached to the cover means for coupling a canopy to the cover means for at least partially covering an individual in the vehicle.

11. The vehicle as in claim 1, wherein said vehicle further comprises means for attaching propulsion means to the frame for propelling the vehicle through the water.

12. The vehicle as in claim 11, wherein said means for attaching propulsion means comprises an oar mount.

13. A floatable aquatic vehicle for receiving and suspending an individual in a seated, floating configuration in water comprising:

a support frame comprising a continuously arcuate enclosure having a first side and an opposing second side, the first and second sides being joined together to form a perimeter;

flexible cover means for encasing buoyant float means and defining a central opening for receiving the individual, said cover means comprising a toric tube having a front section and a rear section, the front section being supported by and conforming to the second side of the frame and the rear section being supported by and conforming to the first side of the frame, the cross sectional area of the toric tube increasing as the toric tube progresses from the front section to the rear section; and means for coupling the support frame to the flexible cover means so that the perimeter of the frame supports the cover means at the opening.

14. The vehicle as in claim 13, wherein said means for coupling the support frame to the flexible cover means further comprises adjustment means for selectively varying the position of the frame with respect to the cover means when the frame is coupled to the cover means.

15. The vehicle as in claim 13, wherein said vehicle further comprises a seat attachable to the frame.

16. The vehicle as in claim 13, wherein said support frame comprises:

a continuously arcuate enclosure having a large radius of curvature at a first side and a smaller radius of curvature at an opposing second side, the first and second sides being joined together to form a perimeter having an egg-shaped configuration and reinforcing means attached diagonally to the perimeter for supporting the perimeter.

* * * * *